US006702281B2

(12) United States Patent
Post et al.

(10) Patent No.: US 6,702,281 B2
(45) Date of Patent: Mar. 9, 2004

(54) DEVICE FOR LOADING A FEEDER RACK

(75) Inventors: Klaus P. Post, Bramsche (DE); Uwe Trox, Stemwede-Wehdem (DE); Andreas Walther, Stadthagen (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 10/190,870

(22) Filed: Jul. 8, 2002

(65) Prior Publication Data

US 2003/0015835 A1 Jan. 23, 2003

(30) Foreign Application Priority Data

Jul. 21, 2001 (DE) ..... 101 35 661

(51) Int. Cl.[7] ..... B65H 7/02

(52) U.S. Cl. ..... 271/258.01; 271/256; 271/259; 271/258.03; 271/265.01; 271/3.01; 271/3.06; 271/3.09

(58) Field of Search ..... 271/3.01, 3.03, 271/3.05, 3.06, 3.08, 3.09, 3.12, 3.13, 150, 270, 256, 258.01, 259, 262, 263, 558.02, 265.01, 265.02, 265.04

(56) References Cited

U.S. PATENT DOCUMENTS

| | | | | | |
|---|---|---|---|---|---|
| 3,776,544 | A | * | 12/1973 | Watson et al. | 271/3.03 |
| 3,904,191 | A | | 9/1975 | Maier, Jr. et al. | |
| 3,945,633 | A | * | 3/1976 | Knopp | 271/3.12 |
| 4,008,890 | A | * | 2/1977 | Pulda | 271/151 |
| 4,134,580 | A | * | 1/1979 | Duzinskas et al. | 271/6 |
| 4,366,955 | A | * | 1/1983 | Pessina et al. | 271/7 |
| 4,618,136 | A | * | 10/1986 | Pessina et al. | 271/150 |
| 4,869,486 | A | * | 9/1989 | Scarpa et al. | 271/3.12 |
| 4,973,038 | A | * | 11/1990 | Curley et al. | 271/146 |
| 5,249,788 | A | * | 10/1993 | Helmstadter | 271/10.07 |
| 5,508,818 | A | * | 4/1996 | Hamma | 358/403 |
| 6,017,028 | A | * | 1/2000 | St. John et al. | 271/3.01 |
| 6,017,029 | A | * | 1/2000 | Bates et al. | 271/3.12 |
| 2002/0079635 | A1 | * | 6/2002 | Pessina et al. | 271/3.01 |

FOREIGN PATENT DOCUMENTS

| | | | | |
|---|---|---|---|---|
| CH | 670441 A5 | * | 6/1989 | B65H/3/02 |
| DE | 297 15 151 U 1 | | 8/1997 | |
| DE | 199 09 518 A1 | | 3/1999 | |
| EP | 0 844 201 A1 | | 10/1997 | |
| JP | 62269829 A | * | 11/1987 | B65H/3/54 |

* cited by examiner

*Primary Examiner*—Donald P. Walsh
*Assistant Examiner*—Matthew J. Kohner
(74) *Attorney, Agent, or Firm*—Alix, Yale & Ristas, LLP

(57) ABSTRACT

In a device for loading a feeder rack (5) in further-processing machines such as gather-stitcher machines or gathering machines (6) for folded sheets (1), sheets, booklets or similar printed products, which has a first conveyor arrangement (15) extending in planar manner for the purpose of feeding printed products (1) standing on their edges in the form of a horizontal stack (2), a second, initially upwardly sloping conveyor arrangement (16) for drawing the printed products (1) off the stack (2) in an overlapping formation and for transferring the overlapping stream (3) to the feeder rack (5), infinitely variable drives (20, 24) associated with the two conveyor arrangements (15, 16), and a light barrier (31) arranged in the feeder rack (5), a control means (23) is provided by means of which the drives (20, 24) can be controlled in dependence on the degree of coverage (BG) of the light barrier (31), as a result of which the fill level of the feeder rack (5) remains at an at least substantially constant height determined by the position of the light barrier (31). This improves the transfer of the printed products (1) to the feeder rack (5).

22 Claims, 2 Drawing Sheets

10
8
9
2
15
17
18
B
1
19
33
34
27
7
16
28
29
3
30
4
5
31
32
6
13
14
12
11
21
20
22
R
23
S
24
25
26
B
H
D

DEVICE FOR LOADING A FEEDER RACK

BACKGROUND OF THE INVENTION

The invention relates to a device for loading a feeder rack in further-processing machines such as gather-stitcher machines or gathering machines for folded sheets, sheets, booklets or similar printed products.

Devices of this type are known as rod feeders, transfer devices, loading devices or delivery devices and are used to break up so-called rods of printed products and to transfer the printed products to a feeder rack of a further-processing machine, such as a gathering machine. For the purpose of breaking up the rod, the printed products are removed from the end face of the rod in overlapping manner, in that the horizontal rod is fed by a conveyor belt towards an upwardly sloping conveying transfer belt, where the conveying speed is greater than the feed speed of the first conveyor belt. As a result of the friction between the transfer belt and the end face of the rod, the printed products are drawn off the rod in an overlapping formation. The rod feeder can also be used to feed individual printed sheets onto the conveyor belt, thus significantly increasing the feeding capacity at the particular feeder rack.

Because a gathering machine or similar further-processing machine can have a plurality of feeder racks, in order to achieve a high effective output it is necessary for the feeder rack to be provided with a continuous supply of printed products. To this end, two light barriers, which are mounted in the feeder rack and show a maximum and a minimum fill level, are associated with the particular rod feeder, the conveyance of printed products by the rod feeder being switched on and off by way of these light barriers. Here, the conveying capacity of the rod feeder is greater than the processing capacity of the gathering machine and has to be set accordingly by the operator. The fill level of the feeder rack swings between the upper and lower light barrier. This results in varying weight-induced loads on the bottom printed product, which is the next to be separated and supplied to the collecting channel of the gathering machine. As a result, functionally reliable operation of the feeder rack is no longer ensured and the effective output of the gathering machine, and thus the entire production section, is reduced. Moreover, the drop height or transfer level of the printed products supplied to the feeder rack varies, which can result in the printed products not being positioned correctly on top of one another in the manner necessary for separation.

SUMMARY OF THE INVENTION

The object of the invention is to provide a loading device that improves the transfer of sheet-like printed products to the feeder rack of a further-processing machine.

This object is achieved according to the invention in a surprisingly simple and economical manner by controlling the conveyor drives in dependence on the degree of coverage (BG) of a light barrier to maintain the fill level of the feeder rack at a substantially constant target height determined by the position of the light barrier.

The loading device according to the invention maintains the fill level of the feeder rack at an at least substantially constant height as it is loaded with printed products. Thus, the separating procedures in the feeder rack are not impeded by fluctuating fill levels. The fill level of the feeder rack is determined by the position of the light barrier. This light barrier is preferably arranged in the feeder rack at the height of the second conveyor arrangement transferring the printed products horizontally to the feeder rack. The overlapping stream generated in the rod feeder is transferred to the feeder rack in a the plane of the horizontal portion of the transfer belt and is fed into the feeder rack in virtually flat manner, as a result of which the printed products are no longer dropped randomly into the feeder rack, but are deposited on top of one another, stacked in optimum manner.

In an advantageous further development, the control means has an analysis means which analyses the signals of the light barrier at the start of each time cycle over a particular number of subsequent time cycles for the purpose of averaging the light-barrier coverage. The control means regulates the drives of the conveyor arrangements in respect of this light-barrier coverage, with the aim that the light barrier maintains a predetermined ideal degree of coverage. The factor by which the conveying speeds of the conveyor arrangements are increased or reduced is preferably adapted to the extent of the deviation of the averaged light-barrier coverage from the predetermined ideal degree of coverage. It has been shown that an optimum regulating behaviour is set using a continuous PI controller. The rod feeder follows fluctuating removal quantities virtually synchronously, so that the fill level set in the feeder rack is always constant. The analysis of the light-barrier signals preferably continues over ten time cycles. A time cycle of 100 ms formed by the control means has proven particularly advantageous, as has specifying 50% as the ideal degree of coverage.

The regulating behavior is safeguarded in simple manner by installing a second lower light barrier, which transmits a signal to the control means in the event of a change in the condition of the coverage, whereby the control means alters the factor for increasing or reducing the conveying speeds of the conveyor arrangements. A sharp increase in the number of printed products removed from the feeder rack, for example at the start of production, is thus dealt with successfully. By means of the proposed solution, it is possible to operate a rod feeder in virtually fully automatic manner, since it adapts automatically to the particular fill level of the feeder rack and thus finds the optimum setting for the conveying speeds of the conveyor arrangements. In an advantageous further development of the device, the drive of the second conveyor arrangement is constructed as the master which the drive of the first conveyor arrangement follows as the slave. The conveying speed of the second conveyor arrangement can therefore be altered for the purpose of regulating the conveying capacity of the device, and the feed speed of the first conveyor arrangement adapts automatically to this changed conveying capacity in order to maintain a defined speed ratio between the two conveyor arrangements. This is necessary to achieve a uniform degree of overlap and is preferably set in dependence on the thickness of the printed products to be processed.

BRIEF DESCRIPTION OF THE DRAWINGS

The invention is explained in more detail below with reference to the exemplary embodiment illustrated schematically in the drawing, wherein.

BRIEF DESCRIPTION OF THE PREFERRED EMBODIMENT

Figures 1, 2:
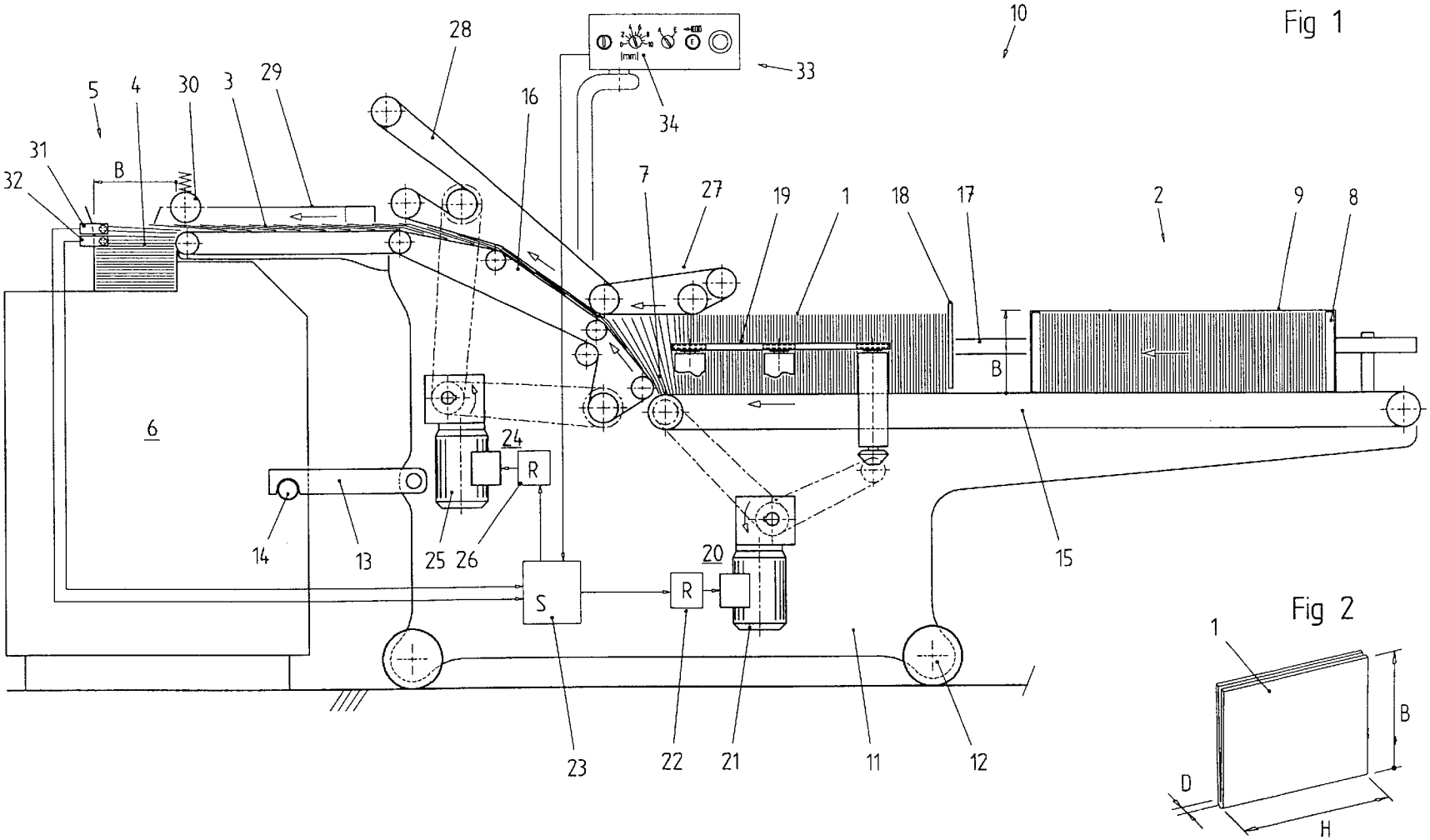
FIG. 1 shows a side view of a rod feeder as a device for loading a feeder rack in gathering machines for folded sheets.
FIG. 2 shows a perspective illustration of a folded sheet.

The rod feeder 10 is movably constructed on wheels 12 and is positioned on a feeder rack 5 of a gathering machine 6 by way of a notch lever 13 and a receiving means 14. It comprises a frame 11 in which a first conveyor arrangement (a substantially horizontal conveyor belt 15) and a second conveyor arrangement (an initially upwardly sloping and then substantially horizontally conveying transfer belt 16) are arranged. The conveyor belt 15 serves to receive folded sheets 1 which are delivered to the conveyor belt 15 standing on one of their edges in loose manner or bundled together to form a rod 2. The folded sheets 1, which are bundled together after folding to form the rod 2, are held at the ends by boards 8 which are braced together by hoop belts 9. The rods 2 can be moved by appropriate devices and are particularly suitable for relatively large batches of folded sheets 1. The rod 2 deposited on the conveyor belt 15 of the rod feeder 10 is firstly fed to the end of a previously deposited rod, where the folded sheets 1 are held in a standing stacked formation by a stack retainer 18. The stack retainer 18 can be pivoted out and placed behind the newly supplied rod 2. The hoop belts 9 and the boards 8 are finally removed.

For the purpose of removing the folded sheets 1 of the rod 2 in overlapping manner, they are fed by the conveyor belt 15 towards the upwardly sloping conveying transfer belt 16, whereof the conveying speed is greater than the feed speed of the conveyor belt 15. In the overlap formation region 7, the folded sheets 1 are drawn off the rod 2 as an overlapping stream 3 due to the friction between the transfer belt 16 and the end face of the rod 2. As seen in the transport direction, lateral guides 17 are associated with the conveyor belt 15 at the rear, and transversely lying chain conveyors 19 are associated with the conveyor belt 15 at the front. The latter are driven synchronously with the conveyor belt 15 and, approximately in the centre of their conveying path, constrict the transport channel for the folded sheets 1 such that these latter are forced to bulge out. The folded sheets 1 are therefore loosened and can be moved away from one another more easily in overlapping manner. In the front region of the conveyor belt 15, an upper belt 27 is arranged above the folded sheets 1 and conveys the folded sheets 1 forwards towards the sloping transfer belt 16.

In the first upwardly sloping conveying portion, a synchronously driven upper belt 28 is associated with the transfer belt 16 for the purpose of reliably transporting the overlapping stream 3. In the second, substantially horizontal, conveying portion of the transfer belt 16, lateral guide plates 29 guide the overlapping stream 3. As a result of an upper roller 30, which is arranged at the end of the transfer belt 16 and located on the transfer belt 16, spring mounted by way of a rocking arm (not illustrated in more detail), the folded sheets of the overlapping stream 3 are fed or expelled into the feeder rack 5 of the schematically indicated gathering machine 6. A flat stack 4 of folded sheets 1 is formed in the feeder rack 5. In FIG. 1, the folded-sheet width of the folded sheet 1 is denoted by B. The further dimensions of a folded sheet 1, such as the folded-sheet height H and the folded-sheet thickness D can be seen in FIG. 2.

The conveyor belt 15 and the two lateral chain conveyors 19 are drive connected to an infinitely variable drive 20 which is formed by a gear motor 21 and a regulator 22. A further infinitely variable drive 24 is provided for driving the transfer belt 16 with the associated upper belt 28. The upper belt 27 is also coupled to this drive 24, which comprises a gear motor 25 and a regulator 26. Both drives 20, 24 are controlled by a central control means 23, the drive 24 of the transfer belt 16 being constructed as the master, and the drive 20 of the conveyor belt 15 following the drive 24 as the slave. In the exemplary embodiment illustrated, two light barriers 31, 32 mounted in the feeder rack 5 of the gathering machine 6 are associated with the control means 23, said light barriers monitoring the fill level of the feeder rack 5 as it is loaded with folded sheets 1 delivered in the form of an overlapping stream 3.

According to the invention, the control means 23 regulates the drives 20, 24 in dependence on the degree of coverage BG of the light barrier 31 and thus maintains the fill level of the feeder rack 5 at a constant height determined by the position of the upper light barrier 31. During loading of the feed rack, the light barrier 31 is intermittently covered by the flat stack 4 formed in the feeder rack 5 and by further folded sheets 1 being fed in. The signal from this light barrier 31 is analysed in the control means 23 of the rod feeder 10 for the purpose of controlling the drives 20, 24. As shown in FIG. 1, the upper light barrier 31 is arranged in the feeder rack, approximately at the height of the second conveyor arrangement 16 transferring the folded sheets 1 horizontally to the feeder rack 5. The overlapping stream 3 is thus fed onto the flat stack 4 formed in the feeder rack 5 in virtually flat manner.

Figure 3:
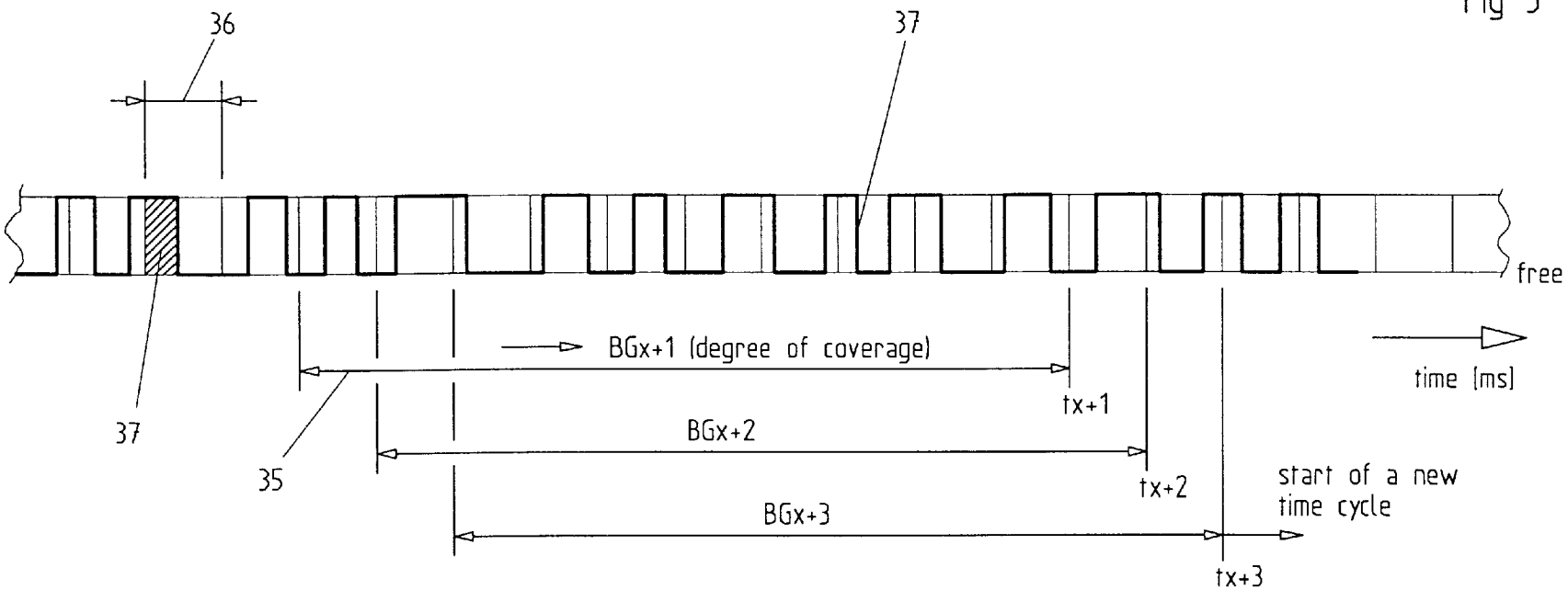
FIG. 3 shows a timing diagram associated with the preferred technique for generating a control signal for the loading device.

The control means 23 regulates the rod feeder 10 in the manner described below with reference to FIG. 3, which is a generalized timing diagram. A total time cycle 35 of preferably 1000 ms and a time cycle increment 36 of preferably 100 ms are formed inside the control means 23. At the start of each time cycle increment 36, the incremental coverage time 37 for the upper light barrier 31 is determined for each increment for the total time cycle 35 before that start of a time cycle, i.e., ten incremental time cycles and therefore for the last 1000 ms. As a concrete example, this total time coverage may be 350 ms at the start of a time cycle $t_{x+1}$. This produces a degree of coverage of $BG_{x+1}$=35%. The deviation from a predetermined ideal degree of coverage of $BG_{id}$=50% is therefore 15%. The control means 23 concludes from these values that the current control of the drives 20, 24 is resulting in too few folded sheets 1 being delivered to the feeder rack 5. Starting from a basic value $BW_x$, which may be 15 Hz in the example, the actual conductance $LW_x$ of for example 16 Hz for the regulator 22, 26 of the gear motors 21, 25 is altered in the manner below $$BW_{x+1}=BW_x+Bp$$

$$BW_{x+1}=15\text{ Hz}+0.25\text{ Hz}=15.25\text{ Hz}$$

$$LW_{x+1}=BW_{x+1}\cdot[1+(BGid-BG_{x+1})]$$

$$LW_{x+1}=15.25\text{ Hz}\cdot[1+(0.5-0.35)]=17.54\text{ Hz}$$

Bp representing a constant value for the positive correction. At the start of the next time cycle (e.g., $t_{x+2}$) a further under-coverage of $BG_{x+2}$=45% may be determined by the control means 23. The new conductance $LW_{x+2}$ is then $$BW_{x+2}=BW_{x+1}+Bp$$

$$BW_{x+2}=15.25\text{ Hz}+0.25\text{ Hz}=15.50\text{ Hz}$$

$$LW_{x+2}=BW_{x+2}\cdot[1+(BGid-BG_{x+2})]$$

$$LW_{x+2}=15.50\text{ Hz}\cdot[1+(0.5-0.45)]=16.28\text{ Hz}$$

For the next time cycle (e.g., $t_{x+3}$), there may be for example an over-coverage of $BG_{x+3}$=60%. The control means 23 reacts in the manner below $$BW_{x+3}=BW_{x+2}-Bn$$

$$BW_{x+3}=15.50\text{ Hz}-0.25\text{ Hz}=15.25\text{ Hz}$$

$$LW_{x+3}=BW_{x+3}\cdot[1-(BG_{x+3}-BGid)]$$

$$LW_{x+3}=15.50\text{ Hz}\cdot[1-(0.6-0.5)]=13.95\text{ Hz}$$

Here, Bn represents a constant value for the negative correction. By way of example, at the start of the fourth time cycle, a total coverage time of 500 ms for the light barrier 31 would have been determined for the subsequent ten time cycles. The degree of coverage $BG_{x+4}$=exactly 50% and corresponds to the ideal degree of coverage BGid. The control means 23 sets the conductance $LW_{x+4}$ to the basic value $BW_{x+4}$, which undergoes neither positive nor negative correction due to the fact that the degree of coverage $BG_{x+4}$ determined corresponds to the ideal degree of coverage $BG_{id}$.

$$BW_{x+4}=BW_{x+3}\ BW_{x+4}=15.25\text{ Hz}$$

$$LW_{x+4}=BW_{x+4}\ LW_{x+4}=15.25\text{ Hz}$$

For any degree of coverage BG for the subsequent time cycles, the basic value BW and the actual conductance LW communicated by the regulators 22, 26 are calculated according to the formulae shown above.

The regulating behaviour of the control means 23, which is realized by the formulas shown above, corresponds to that of a continuous PI (proportional and integral) controller. The factor by which the conductance LW is increased or decreased is calculated in dependence on the deviation of the actual degree of coverage BG, representing a statistical mean value, from the ideal degree of coverage BGid. The particular starting value for calculating the new conductance $LW_{new}$ is not the previous conductance $LW_{new-1}$, but a basic value BW which is held in the control means 23 and is increased or reduced by a constant value Bp or Bn depending on the deviation in the degree of coverage BG. The variables shown here in the exemplary embodiment for the length of the time cycle, the number of time cycles for the statistical generation of the mean value of the degree of coverage BG, and for the ideal degree of coverage BGid only represent a preferred variant. It is of course also possible for an applicable regulating behaviour to be realised with values other than those given here.

The control means 23 regulates the drives 20, 24 by detecting constantly fluctuating fill levels resulting from the discrepancy between the quantity of folded sheets 1 delivered by the rod feeder 10 and the quantity processed by the gathering machine 6. However, on average, the feeder rack 5 is provided with a precisely corresponding quantity of folded sheets 1. Despite the constant-readjustment of the drives 20, 24, the feeder rack 5 is loaded in astonishingly uniform manner.

The two conveyor arrangements 15, 16 are operated at a constant speed ratio to one another depending on the particular thickness D of the folded sheets to be processed. The thickness D is preset at an operating console 30 by way of a rotary potentiometer 34. The delivery capacity of the rod feeder 10 is altered by controlling the drive 24 of the transfer belt 16. The drive 20 of the conveyor belt 15 adapts itself accordingly to maintain the constant speed ratio and therefore a constant degree of overlap.

An optional lower light barrier 32 can be provided in the feeder rack 5, to safeguard the regulating behaviour of the control means 23 for extreme changes in the fill level of the feeder rack 5. The light barrier is normally covered when the fill level is at or near the target level, but if the light barrier 32 is not covered, the constant value Bp for the positive correction of the basic value BW is set to a substantially higher value. If this measure is not sufficient and the lower light barrier 32 remains uncovered over a particular time period, troubleshooting measures are initiated, since there is obviously a fault with the loading effected by the rod feeder 10. For the upper light barrier 31, if coverage is continuous over a particular time period, the control means 23 stops the gathering machine 6 and therefore interrupts loading by the rod feeder 10. Loading is continued only once the upper light barrier 31 is cleared.

What is claimed is:

1. A device for loading a stream of sheet-like printed products to a target fill level in a feeder rack of a machine for further processing of the printed products, comprising:

a first conveyor for transporting printed products standing on edge in the form in a horizontal stack;

a second conveyor extending initially obliquely upwardly for drawing the printed products off the horizontal stack in an overlapping stream and for transferring the overlapping stream to said feeder rack;

a continuously variable drive associated respectively with each conveyor;

a light barrier arranged in the feeder rack and responsive to covering of a light beam by products in the feeder rack and thereby determining the degree to which the fill level is at or above the light beam; and control means for controlling the drives in dependence on the degree of coverage (BG) of the light barrier, by continuous variable increases or decreases of the conveying speeds, to maintain the fill level of the feeder rack at a substantially constant height determined by the position of the light barrier.

2. A device according to claim 1, wherein the second conveyor transfers the products horizontally into an inlet of the feeder rack and the light barrier is arranged in the feeder rack at the height where the second conveyor transfers products horizontally to the inlet of the feeder rack.

3. A device according to claim 2, wherein a speed ratio between the two conveyors is set by the control means in dependence on the thickness (D) of the printed products.

4. A device according to claim 1, wherein the drive associated with the second conveyor is configured as the master which the drive associated with the first conveyor follows as a slave for the purpose of maintaining a defined speed ratio.

5. A device according to claim 4, wherein the second conveyor transfers the products horizontally into an inlet of the feeder rack and the light barrier is arranged in the feeder rack at the height where the second conveyor transfers products horizontally to the inlet of the feeder rack.

6. A device according to claim 4, wherein the control means generates an incremental time cycle and includes an analysis means for the statistical generation of the mean value of the light-barrier coverage, which is carried out at the start of each incremental time cycle for a total time cycle consisting of particular number of incremental time cycles before that start of a time cycle; and regulates the drives of the conveyor in dependence on the mean values of the light-barrier coverage (BG), such that the light barrier maintains a predetermined degree of coverage (BGid).

7. A device according to claim 4, wherein a speed ratio between the two conveyors is set by the control means in dependence on the thickness (D) of the printed products.

8. A device for loading a stream of sheet-like printed products to a target fill level in a feeder rack of a machine for further processing of the printed products, comprising:

a first conveyor for transporting printed products standing on edge in the form in a horizontal stack;

a second conveyor extending initially obliquely upwardly for drawing the printed products off the horizontal stack in an overlapping stream and for transferring the overlapping stream to said feeder rack;

a continuously variable drive associated respectively with each conveyor;

a light barrier arranged in the feeder rack and responsive to covering of a light beam by products in the feeder rack and thereby determining the degree to which the fill level is at or above the light beam; and control means for controlling the drives in dependence on the degree of coverage (BG) of the light barrier to maintain the fill level of the feeder rack at a substantially constant height determined by the position of the light barrier;

wherein the control means generates an incremental time cycle and includes an analysis means for the statistical generation of the mean value of the light-barrier coverage, which is carried out at the start of each incremental time cycle for a total time cycle consisting of a particular number of incremental time cycles before that start of a time cycle; and regulates the drives of the conveyor in dependence on the mean values of the light-barrier coverage (BG), such that the light barrier maintains a predetermined degree of coverage (BGid).

9. A device according to claim 8, wherein on analysing the actual mean value, the control means either increases or reduces the conveying speeds of the conveyors by a factor which is dependent on the deviation of the actual value of the degree of coverage (BG) from the predetermined set value of the degree of coverage (BGid).

10. A device according to claim 8, wherein the control means includes a continuous PI controller.

11. A device according to claim 8, wherein the total time cycle consists of ten incremental time cycles before that start of a time cycle.

12. A device according to claim 8, wherein said incremental time cycle is 100 ms.

13. A device according to claim 8, wherein the predetermined degree of coverage (BGid) is 50 percent.

14. A device according to claim 9, comprising a second light barrier which is arranged in the feeder rack at a height where the second light barrier is normally covered when the products are at the target fill level, and which transmits a signal to the control means in the event the second light barrier is uncovered, for altering the factor and thereby increasing or reducing the conveying speeds of the conveyors.

15. A device according to claim 8 wherein the second conveyor transfers the products horizontally into an inlet of the feeder rack and the light barrier is arranged in the feeder rack at the height where the second conveyor transfers products horizontally to the inlet of the feeder rack.

16. A device according to claim 9, wherein the second conveyor transfers the products horizontally into an inlet of the feeder rack and the light barrier is arranged in the feeder rack at the height where the second conveyor transfers products horizontally to the inlet of the feeder rack.

17. A device according to claim 10, wherein the second conveyor transfers the products horizontally into an inlet of the feeder rack and the light barrier is arranged in the feeder rack at the height where the second conveyor transfers products horizontally to the inlet of the feeder rack.

18. A device according to claim 11, the second conveyor transfers the products horizontally into an inlet of the feeder rack and the light barrier is arranged in the feeder rack at the height where the second conveyor transfers products horizontally to the inlet of the feeder rack.

19. A device according to claim 12, wherein the second conveyor transfers the products horizontally into an inlet of the feeder rack and the light barrier is arranged in the feeder rack at the height where the second conveyor transfers products horizontally to the inlet of the feeder rack.

20. A device according to claim 8, wherein the control means controls the drives by continuous variable increases or decreases of the conveying speeds.

21. A device for loading a stream of sheet-like printed products to a target fill level in a feeder rack of a machine for further processing of the printed products, comprising:

a first conveyor for transporting printed products standing on edge in the form in a horizontal stack;

a second conveyor extending initially obliquely upwardly for drawing the printed products off the horizontal stack in an overlapping stream and for transferring the overlapping stream to said feeder rack;

a continuously variable drive associated respectively with each conveyor;

a light barrier arranged in the feeder rack and responsive to covering of a light beam by products in the feeder rack and thereby determining the degree to which the fill level is at or above the light beam; and control means for controlling the drives in dependence on the degree of coverage (BG) of the light barrier to maintain the fill level of the feeder rack at a substantially constant height determined by the position of the light barrier;

wherein a speed ratio between the two conveyors is set by the control means in dependence on the thickness (D) of the printed products.

22. A device according to claim 21, wherein the control means controls the drives by continuous variable increases or decreases of the conveying speeds.

* * * * *